United States Patent [19]

Hefty et al.

[11] Patent Number: 4,566,648

[45] Date of Patent: Jan. 28, 1985

[54] DEVICE FOR APPLYING AND CONVEYING A PROTECTIVE COVER FOR A TOILET SEAT

[75] Inventors: Dipl.-Ing. B. Hefty, Beckenried; Arpad Hefty, Richenthal, both of Switzerland

[73] Assignee: Hygolet AG, Hergiswil, Switzerland

[21] Appl. No.: 657,324

[22] Filed: Oct. 3, 1984

[51] Int. Cl.[4] ..... A47K 13/14; A47K 13/20; A47K 10/38

[52] U.S. Cl. ..... 242/67.3 R; 242/55.2; 4/242

[58] Field of Search ..... 4/242, 247; 242/67.3, 242/68.4, 67.1, 55.2, 55.53; 200/153 T

[56] References Cited

U.S. PATENT DOCUMENTS 3,892,368 7/1975 Ricards ..... 242/55.2
4,213,212 7/1980 Hefty et al. ..... 4/247

FOREIGN PATENT DOCUMENTS 2835257 3/1979 Fed. Rep. of Germany .
3331740 3/1984 Fed. Rep. of Germany ..... 4/242

*Primary Examiner*—Stuart S. Levy
*Assistant Examiner*—Lloyd D. Doigan
*Attorney, Agent, or Firm*—Irvin A. Lavine

[57] ABSTRACT

With a device for applying and conveying a hose-shaped protective covering for a toilet seat, the unwinding spool is supported by a switch tube which passes through it and which transmits the movement of a push button, protruding from the housing, to a switch arranged inside the housing. The unwinding spool can rotate loosely on the switch tube and is essentially independent from the switch tube's axial motion.

14 Claims, 8 Drawing Figures

DEVICE FOR APPLYING AND CONVEYING A PROTECTIVE COVER FOR A TOILET SEAT

Figure 1:
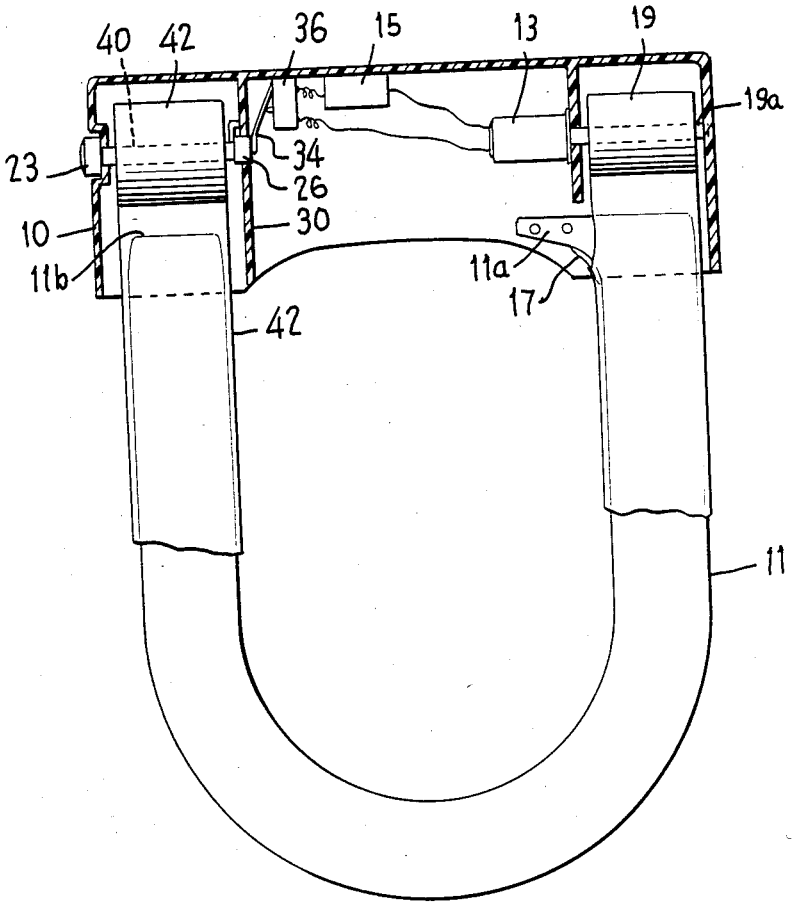

The invention relates to a device for applying and conveying a hose-shaped protective covering for a toilet seat, having a housing which is to be fastened to the toilet seat, said housing containing an unwinding spool from which the protective covering is drawn off and a take-up spool, driven by a battery-operated electromotor, onto which the protective covering is wound up again after use, whereby a push button, which protrudes laterally from the housing on the side of the unwinding spool, can be depressed in the axial direction of the unwinding spool for operating a switch arranged on the opposite side of the unwinding spool for the electromotor.

A device of this type is known from German Pat. No. 28 35 257 corresponding to U.S. Pat. No. 4,213,212 which provides for a direct mounting of the unwinding spool in walls of the housing, whereby the entire unwinding spool is axially shifted when activating the push button and presses onto the on-switch with its opposite end, so that the electromotor is started. With respect to protecting the electrical parts from water, contamination and the like, it is desirable to arrange all electrical parts, namely, the electromotor, battery and on-switch in the middle part of the housing, which is closed off by partitions, separate from compartments provided for unwinding spool and take-up spool. On the other hand, operating the electromotor from the side of the unwinding spool is advantageous, since only at this point, on the one hand, a collison with the gear for starting the take-up spool and, on the other hand, with respect to the collapsibility of the toilet seat with the housing, inaccessibility is avoided in opened or closed position of the toilet seat. While the push button is depressed, its transmission of tractive force via the unwinding spool, however, leads to a slight hindrance of the unwinding of the protective covering, so that the latter can only freely follow the pull exerted by the electromotor after releasing the push button. As a result, the application of an unused part of the protective covering is delayed and distortions could occur.

The present invention is to improve the known device in such a way that, when operating the push button, a free and unhindered start of the unwinding spool can result immediately.

This object is solved according to the invention by a device of the above-mentioned type in that a switch tube, which is in axial thrust connection with the push button, is supported axially movable in the housing for activating the switch and that the unwinding spool is rotatable and axially movable on the switch tube.

By separating the unwinding spool, on which the protective covering is at first wound, from the switch tube, which transmits the thrust of the push button onto the on-switch, a trouble-free operation of the switch, which is independent from the unwinding spool, is now, on the one hand, possible from outside the housing and, on the other hand, an unhindered removal of the protective covering from the unwinding spool can immediately result when starting the electromotor by operation of the on-switch, whereby said unwinding spool can remain in the correct axial position with respect to the raising of the toilet seat and can adjust to this position with free play. For mounting a new unwinding spool, the housing must merely be opened, the empty unwinding spool removed from the switch tube and a new unwinding spool, having a protective covering wound on it, placed on the switch tube. The unwinding spool can be on the switch tube with random clearance, whereby it should merely be ensured that a sufficient sliding ability between unwinding spool and switch tube is given.

The on-switch is preferably made like a pressure switch, that is, actuated by rectilinear movement so that, when the push button is axially depressed, the pressure switch is operated and the motor is started via the switch tube. When the push button is released, the pressure switch is reset due to its elastic action and pushes the switch tube into the initial position.

Basically, the switch tube can also be turned when the unwinding spool is turned. However, in order to avoid the turning of the push button also, which can be seen from the outside, said push button can be supported axially slidable at the housing, separate from the switch tube.

With a practical further embodiment of the invention, the switch tube has, however, axially sliding interlocking clamping parts in openings of a housing wall for securing said switch tube in position without rotation. In this case, the push button can also be securely connected with the switch tube or even made in one piece with it.

In order to prevent an undesired, too great an axial movement of the unwinding spool which sits loose on the switch tube, stops for limiting the axial play of the unwinding spool, protrude, in a further embodiment of the invention, from both sides of the housing walls which are arranged at the axial ends of the unwinding spool.

For practical reasons, these abut against the axial ends of the unwinding spool with a certain axial play, whereby the width of the protective covering, which is on the unwinding spool, is less than the axial length of the unwinding spool. As a result, only a very slight friction is exerted on the assigned stops, even when one end of the unwinding spool abuts directly.

The push button can, as mentioned, be securely connected with the switch tube. It can, however, also be fixed, yet detachable on the switch tube, so that it can be removed for mounting a new unwinding spool. On the other hand, it is also possible to join the clamping parts, preferably located on the opposite end, to a holding part which can be inserted into the open end of the switch tube with limited friction, and which can be removed from the inside in order to mount the new unwinding spool.

With a further advantageous embodiment of the invention, the switch for the motor consists of two switch jacks, which are arranged adjacent to one another in a plane at right angles to the axial direction of the unwinding spool, and the front end of the switch tube which is opposite the switch jacks is electrically conductive for producing a connection between the switch jacks. This embodiment is particularly simple since a special pressure switch is not necessary.

In order to avoid special stops on the housing walls for limiting the axial play of the unwinding spool, in accordance with a further suggestion of the invention, the switch tube has, in the area of both is ends, one all-around protruding flange each, which is arranged within the supporting walls for the switch tube and outside of the ends of the unwinding spool. Thus, the unwinding spool can move freely on the switch tube, yet is held in axial direction by the flange. In this case, the switch tube with the flanges is also replaced as a disposable unit when replacing the unwinding spool. When the switch tube is made of synthetic material, this does not involve high costs.

If the flanges are elastically formed, then they can, moreover, be used in such a way that at least one of these flanges, preferably the flange which is near the on-switch, abuts against an inner housing stop near its peripheral edge. When depressing the push button, the flange is thus slightly bent and ensures that, after release of the push button, due to its elastic force, the switch tube is returned to its initial position. Such a stop can also be provided on the opposite flange in order to precisely set the middle position of the switch tube.

Figure 2:
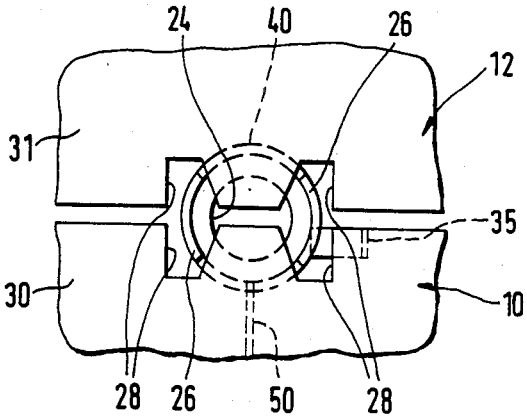
Figure 1B:
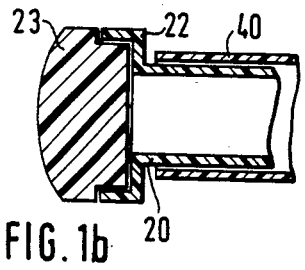
Figure 1A:
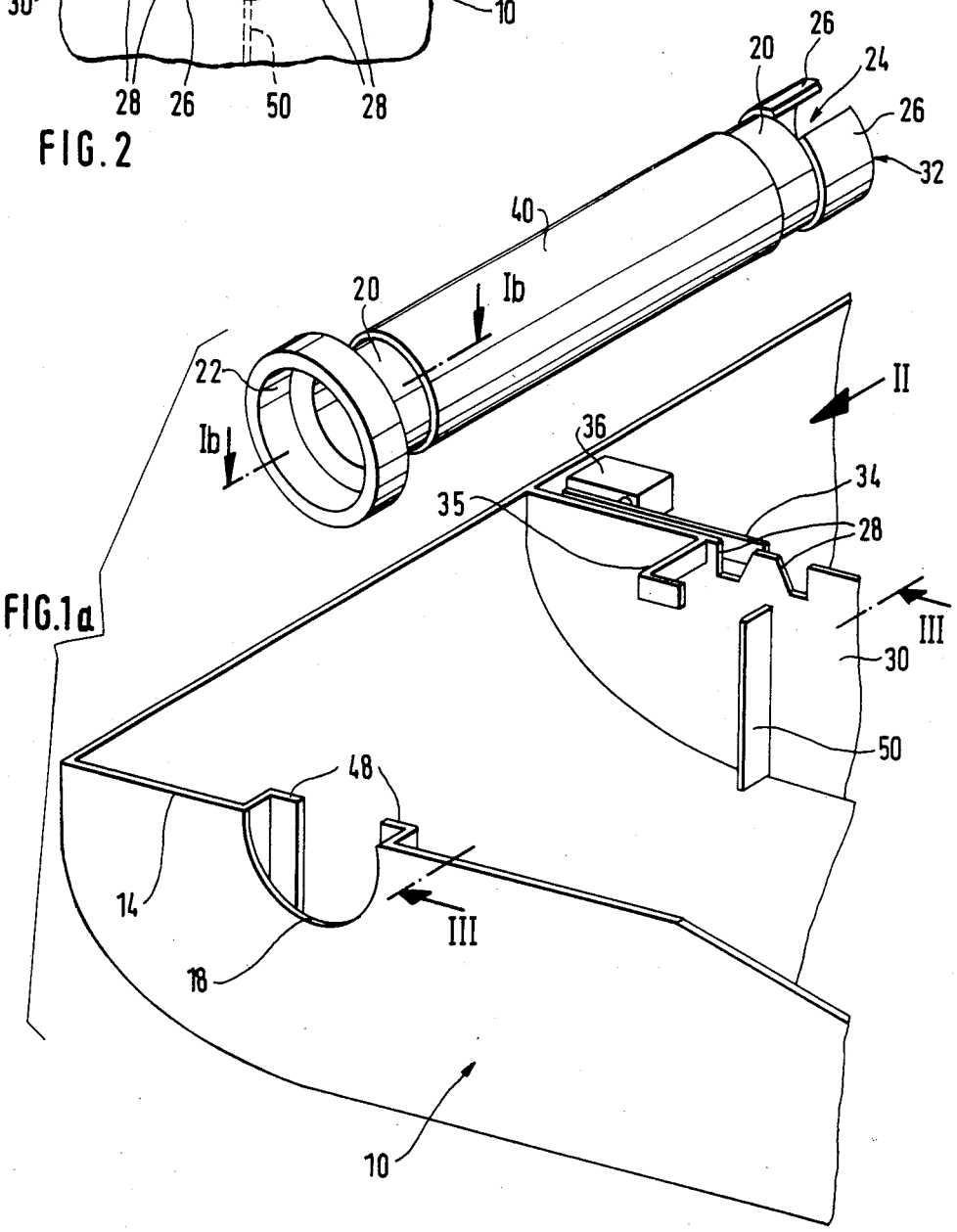
Figure 3:
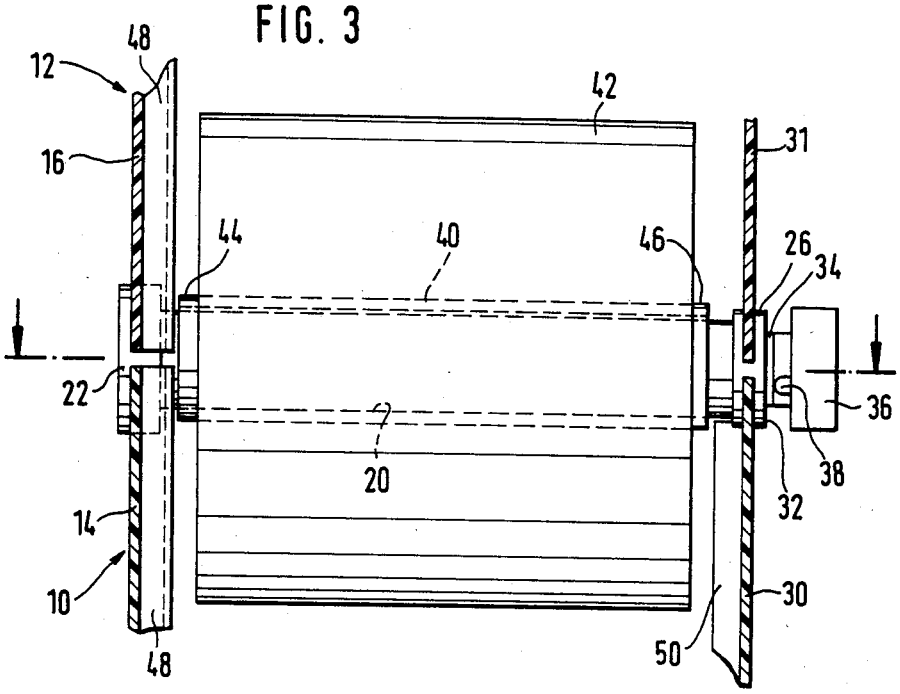
Figure 4:
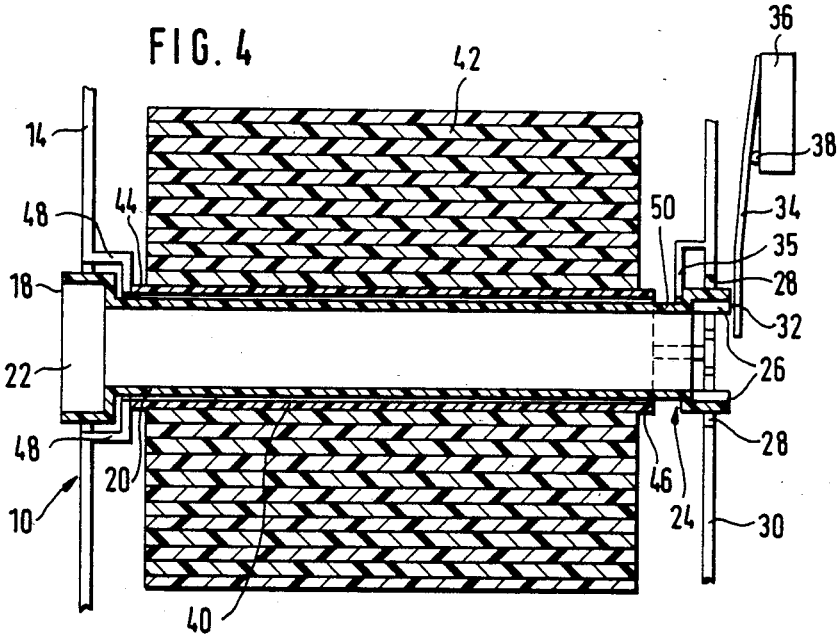
Figure 5:
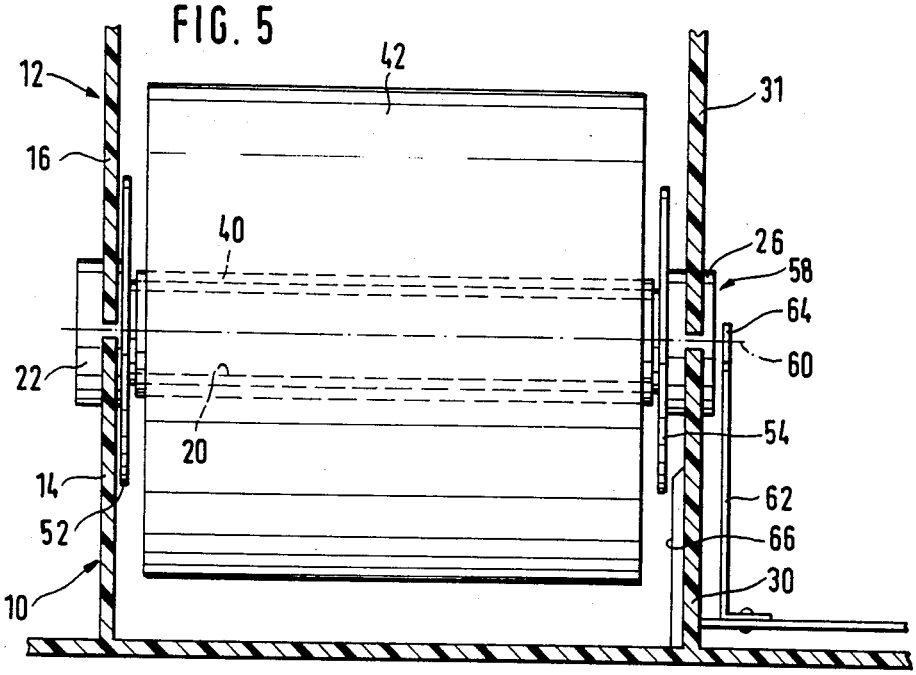
Figure 6:
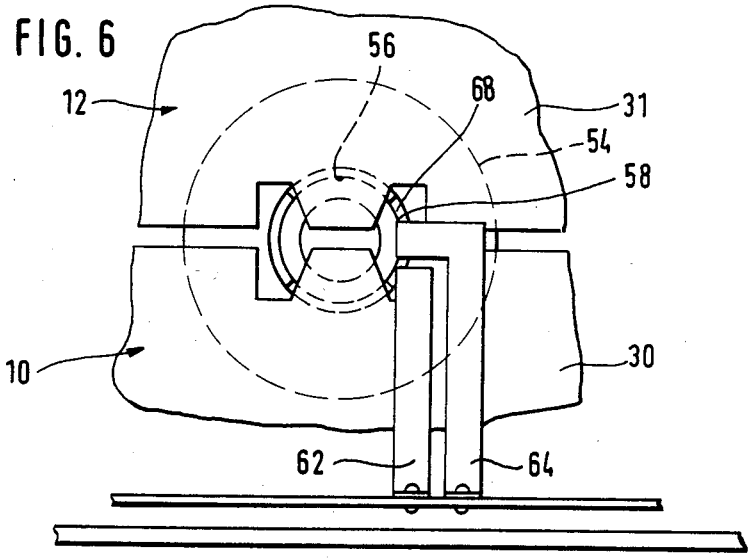

A preferred embodiment of the invention is illustrated in greater detail with reference to the drawings, showing:

FIG. 1 is a plan view with parts in section, of a toilet seat and a housing in accordance with the present invention, FIG 1*a* a partial diagonal view of the lower part of the housing with switch tube which has been removed and arranged above it, in accordance with a first embodiment, FIG. 1*b* an axial partial cut according to the line Ib–Ib in FIG. 1*a*, FIG. 2 a partial view according to the arrow II in FIG. 1*a*, FIG. 3 a partial cut along the line III—III in FIG. 1*a*, FIG. 4 a partial cut along the line IV—IV in FIG. 3, FIG. 5 a partial cut, corresponding to FIG. 3, through a second embodiment, and FIG. 6 a partial view, corresponding to FIG. 2, of the second embodiment.

There is shown in FIG. 1 a toilet seat 11 which is of generally U-shaped configuration, having a first end 11*a* which is connected to a supporting structure, and having a second end 11*b* which is free, being un-connected to any supporting structure. A housing 10 is provided, which covers the ends 11*a* and 11*b* of toilet seat 11, and which houses an electro motor 13, a battery 15, and a switch 36, the electro motor 13 being operably connected to a shaft 19*a* which is supported in the housing, and which carries a wind-up spool 19 of protective covering 42. Protective covering 42 is in the form of a hose, that is, it is tubular, there being provided an unwinding spool 40 for the protective covering 42. Thus, the protective covering 42 extends from the unwinding spool 40 telescopically over the free end 11*b* of toilet seat 11, then along U-shaped toilet seat 11 toward the end 11*a*. End 11*a* carries a cutter 17 which longitudinally cuts or slits the protective covering 42 so that it may be wound up onto the winding-up spool 19 when the shaft 19*a* is rotated by motor 13.

The housing has a lower part, which is generally designated with 10, and an upper part 12, which is not shown in FIG. 1*a*. Lower part 10 and upper part 12 together form a closed housing, whereby they lie closely on top of one another with their edges. A partition 14 and 16 of the housing 10, 12 forms a support 18 for a switch tube 20, which has in one piece at one end an adapter 22, which is arranged outside of the partition 14, 16, for receiving a push button 23 which is only shown in FIG. 1*a*. The push button 23 is, for its part, set axially movable in an outer wall of the housing 10, 12, which is not shown. On the opposite end of the switch tube 20, a holding part, generally designated 24, is situated in one piece. The holding part 24 has two arcuate clamping parts 26 which are arranged in a non-rotatable yet axially movable manner in openings 28 of an inner partition 30, 31 of the housing 10, 12. The free end 32 of at least one of the clamping parts 26 presses against the free ends of a leaf spring 34, whose other end is fastened to a pressure switch 36. The leaf spring 34 usually presses the switch tube 20 into the outer position which is not operated and this is shown in FIGS. 3 and 4. It is held in this position by a stop 35, located on partition 30, said stop abutting against the holding part 24. In this position, the adapter 22 stands outward by a slight distance from the partition 14, 16 of the housing and can be depressed, when operating the push button 23, up to the stop on stop edges 48 which are located on the housing. When depressing the push button 23, the free end 32 of the clamping parts 26 presses against the leaf spring 34. As a result of its movement, the control button 38 of the pressure switch 36 is actuated and the electromotor, which is not shown, started. The electromotor is located in the same middle part of the housing 10, 12—formed by partition 30, 31 and a further partition, which is not shown—as the pressure switch 36 and the battery, which is not shown.

The unwinding spool 40, shown empty in FIG. 1*a*, sits freely rotatable and axially movable on the switch tube 20, whereas, according to FIGS. 3 and 4, a supply of hose-shaped protective covering 42 is wound up which is made, for example, of synthetic material. By operating the push button 23, the electromotor is started via the pressure switch 36 and thus the take-up spool 19 is set into motion, so that the used piece of the protective covering 42 is removed from the toilet seat 11 and rolled up. At the same time, a new piece is removed from the unwinding spool 40 and then covers the toilet seat.

In order to, for instance, fix the axial position of the unwinding spool 40 with a slight exertion of friction, notwithstanding the free mobility and unhindered rotation of the unwinding spool 40 on the switch tube 20, bars 48 or 50, protruding from the side wall 14 or partition 30, abut with great axial play against their axial ends 44 and 46. These bars 48 and 50 exert, on the one hand, an extremely slight friction during rotation of the unwinding spool 40, yet to some extent fix, on the other hand, the axial position of the unwinding spool 40, so that the protective covering 42, which is removed from the unwinding spool 40, can be wound up undistorted and in approximately straight direction onto the adjacent end of the toilet seat, which is not shown. In particular, this axial position of the unwinding spool is only negligibly influenced by operation of the push button 23 and the unwinding of the protective covering 42 from the unwinding spool is thus largely independent from the operation of the push button 23.

In order that the protective covering 42, which is on the unwinding spool 40, does not also stop at the bars 48, 50 when a certain friction is exerted, the two axial ends 44 and 46 of the unwinding spool 40 protrude a little beyond the width of the protective covering 42.

To replace an empty unwinding spool 40, the upper part of the housing 12 is removed from the lower part 10 and the switch tube 20 is taken out of its supports 18, 28 together with the unwinding spool 40. A new switch tube 20, having a full unwinding spool 40, is then inserted, the beginning of the protective covering 42 is pulled over the toilet seat and fastened to the take-up spool, which is not shown, and the housing is then closed again.

With the second embodiment shown in FIGS. 5 and 6, the same reference numbers as in the first embodiment are used for the same parts. At the two front ends of the switch tube 20, one flange each 52 or 54 is provided which protrudes radially on all sides, within which the unwinding spool 40 is pivoted with play to the switch tube 20. On the outside of the right flange 54, the clamping parts 26 are attached in one piece as continuation of the switch tube 20, whereby the front end 58 of at least one clamping part 26 is electrically conductive. Two conductive switch jacks 62, 64 are arranged adjacent to one another opposite the conductive end 58 in a plane which is at right angles to the longitudinal axis 60 of the switch tube 20, these switch jacks are connected with the motor in a manner which is not shown in greater detail. When the push button 23 is depressed, the conductive end 58 is connected with the two switch jacks 62, 64 and, as a result, the motor is started. With this axial shifting of the switch tube 20, the outer edge of the elastically formed flange 54, which abuts against an inner stop 66 of the lower part 10 in the illustrated rest position, is elastically bent. After release of the push button 23, the switch tube 20 is returned to its initial position by the elastic force of the bent flange edge 64. The tube attachment 56 is freely movable in axial direction in a circular recess 68 of the partition 30, 31.

We claim:

1. A device for applying and conveying a hose-shaped protective covering for a toilet seat, the device having a housing containing an unwinding spool, from which the protective covering is drawn off, and a take-up spool, a battery-operated electro motor operatively connected to the take-up spool, the protective covering being rolled up on the take-up spool after use, a push button protruding laterally from the housing on the side of the unwinding spool, a switch opposite the unwinding spool operatively connected to the electro motor, the improvement comprising means for actuating said switch comprising a switch tube axially moveable in the housing, the unwinding spool being rotatable and axially movable on the switch tube, said push button engageable with said switch tube for moving said switch tube axially to actuate said switch.

2. A device according to claim 1, wherein the push button is supported by the switch tube.

3. A device according to claim 1, and means for securing said switch tube in position comprising means on said switch tube engageable with said housing for permitting axial movement of said switch tube and for preventing rotational movement thereof.

4. A device according to claim 3, in said means on said switch tube comprising a holding part frictionally engageable with said switch tube at an open end thereof.

5. A device according to claim 1, and stop means on said housing for limiting the axial movement of the unwinding spool.

6. A device according to claim 5, said unwinding spool having a greater axial length than the axial length of the protective covering wound thereon, and wherein said stop means are spaced further apart than the length of said unwinding spool.

7. A device according to claim 1, wherein said push button is rigidly fastened to the switch tube.

8. A device according to claim 1, wherein said push button is detachably connected to the switch tube.

9. A device according to claim 1, said switch comprising a housing, an operating arm extending from said housing, a portion of said operating arm positioned for engagement by said switch tube upon axial movement thereof in one direction by said push button.

10. A device according to claim 9, said operating arm comprising means for resiliently urging said switch tube in the opposite direction.

11. A device according to claim 1, said switch comprising two conductive switch jacks in adjacent, spaced relationship to each other and in alignment with an end of said switch tube, conductive means on said end of the switch tube for engaging both said conductive jacks upon axial movement of said switch tube in one direction by said push button.

12. A device according to claim 11, and means for resiliently urging said switch tube in the opposite direction.

13. A device according to claim 12, said last mentioned means comprising a flange on said switch tube within said housing and adjacent said end of said switch tube, and means on said housing for engagement by said flange upon axial movement of said switch tube in said one direction.

14. A device according to claim 1, said switch tube having a flange adjacent each end thereof, said flanges being within said housing and outwardly of said unwinding spool.

* * * * *

UNITED STATES PATENT AND TRADEMARK OFFICE

CERTIFICATE OF CORRECTION

PATENT NO. : 4,566,648

DATED : Jan. 28, 1986

INVENTOR(S) : Hefty et al.

It is certified that error appears in the above-identified patent and that said Letters Patent are hereby corrected as shown below:

Line 2, [45] Date of Patent: "1985" should be deleted and --1986-- should be inserted in place thereof.

Signed and Sealed this

*Seventeenth* Day of *June 1986*

[SEAL]

*Attest:*

DONALD J. QUIGG

*Attesting Officer*

*Commissioner of Patents and Trademarks*